US005911334A

United States Patent [19]

Helms

[11] Patent Number: 5,911,334

[45] Date of Patent: Jun. 15, 1999

[54] CLOSABLE ARRANGEMENT INCLUDING RESEALABLE LID

[75] Inventor: Charles R Helms, Malvern, Pa.

[73] Assignee: Double "H" Plastics, Inc., Warminster, Pa.

[21] Appl. No.: 08/963,364

[22] Filed: Nov. 3, 1997

[51] Int. Cl.[6] ..... B65D 41/00

[52] U.S. Cl. ..... 220/359.4; 220/780; 220/359.3; 220/377; 229/5.5; 229/123.1

[58] Field of Search ..... 220/780–782, 220/796, 359.1, 359.2, 359.3, 359.4, 260, 377; 215/232, 317; 229/5.5, 123.1; 706/484.1, 484.2; 426/106, 109, 110, 118, 124, 125, 126, 127

[56] References Cited

U.S. PATENT DOCUMENTS

| | | | |
|---|---|---|---|
| 2,893,456 | 7/1959 | Wallace | 220/377 X |
| 4,171,084 | 10/1979 | Smith | 220/359.3 X |
| 4,238,047 | 12/1980 | Helms et al. | 220/782 |
| 4,390,552 | 6/1983 | Niwa | 215/232 X |
| 4,418,834 | 12/1983 | Helms et al. | 220/359.4 X |
| 4,442,971 | 4/1984 | Helms | 220/780 X |
| 4,448,345 | 5/1984 | Helms | 220/359.4 X |
| 4,875,587 | 10/1989 | Lulham et al. | 426/127 |
| 5,167,974 | 12/1992 | Grindrod et al. | 426/127 |
| 5,178,293 | 1/1993 | Suzuki et al. | 229/123.1 X |
| 5,191,980 | 3/1993 | Boffito et al. | 220/359.4 X |
| 5,634,567 | 6/1997 | Hekal | 220/359.4 X |
| 5,779,050 | 7/1998 | Kocher et al. | 220/260 |

*Primary Examiner*—Stephen K. Cronin
*Assistant Examiner*—Nathan Newhouse
*Attorney, Agent, or Firm*—Robert J. Black

[57] ABSTRACT

A peelable and resealable closure arrangement for a container body and lid that ensures integrity of the seal, including a tubular container body including a peripheral rim extending radially outward from the body wall and a lid including a flat central panel including a membrane layer peelable from the rim. The membrane including a layer of film compatible for heat sealing to an upper surface of the container body rim.

22 Claims, 2 Drawing Sheets

CLOSABLE ARRANGEMENT INCLUDING RESEALABLE LID

BACKGROUND OF THE INVENTION

1. Field of the Invention

This invention relates generally to closure arrangements, and more particularly it relates to a closure arrangement including a composite lid composed of a molded plastic rim and a flexible film central panel adapted to be secured to a container body having a rim which can be hermetically sealed to the lid.

2. Background Art

A search of the records of the U.S. Patent Office directed at the subject matter of this application discovered the following U.S. Pat. Nos.:

| | | |
|---|---|---|
| 3,428,208 | 4,154,360 | 5,125,529 |
| 3,892,351 | 4,442,971 | 5,160,767 |
| 3,934,749 | 4,542,029 | 5,167,339 |
| 4,044,941 | 4,605,142 | 5,328,045 |
| 4,094,460 | 4,856,674 | 5,439,132 |
| 4,141,463 | 5,069,355 | |

A review of the above patents determined that none of the patents disclosed or claimed a closure arrangement with a one-piece resealable lid as taught within the present application.

The present invention is drawn to a lid or cover for a cup of the type where it snaps over a flange of the cup. The cup is retained in place by a clip or undercut. Typically, such cover which includes a paperboard or plastic central panel is snapped over a membrane or foil seal and the package is opened in two steps. The first is removal of the cap and the second being removal by peeling off of the membrane. In this arrangement, the lid is then available to reclose the package.

Membranes for sealing cups of this sort are typically accomplished by one of several ways. This first of these is the utilization of a flexible film applied off the roll to the top of the cup and heat-sealed onto the flange and then cut from a web. As an alternative, individual precut membranes are fed from stacks. These are typically aluminum foil and are textured to stiffen and are very expensive. Another approach is the utilization of membranes which are preinserted into caps and induction sealed to flanges. This system also requires foil and generally is limited to small screw cap enclosures. Membranes of the types applied above are typically sealed with conduction wherein a hot dye is applied under pressure until the membranes sealant is bonded to the cup flange. In another approach, the membranes are sealed by induction wherein an electrical field is induced in aluminum foil to generate the necessary heat for sealing.

In the arrangements outlined above, the heated dye must have direct contact to the sealing area and without any thick layers of material in the way, and by means of induction, heat can be induced deeply within the structure.

SUMMARY OF THE INVENTION

It is one object of the present invention to provide an enclosure of the type disclosed with means for insuring that the integrity of the seal between the container and the lid will be maintained even though internal pressure generated within the container may cause the center of the lid to deflect out of its normal horizontal plane.

A more specific object of the invention is to provide a container lid edge having a radially inward projected lip with a peripheral edge capable of engaging the container body rim to insure a seal between the sealable membrane and the container rim.

In the present invention, the membrane has a rigid edge affixed to it and the membrane is lifted off the rim and replaced by snapping onto the cup flange as an over cap. The present invention allows the use of inexpensive flexible films, but with the convenience and flexibility of feeding from a stack rather than a web, and applying membranes of the type identified above in the prior art, as being sealed by conduction wherein a hot dye is applied under pressure until the membrane sealant is bonded to the cup flange.

In the present embodiment, the flexible thin membrane is sealed conductively to the cup rim inboard of its outer edge with the rim affixed to the outer perimeter of the membrane. This allows the membrane to be handled and applied like a lid but also allows the membrane to be removed and reclosed like a lid. Thus, only one component consisting of the rim and the membrane is utilized as opposed to two separate layers of membrane and cover as utilized in the prior art.

In the present arrangement, inasmuch as the panel of the lid is of membrane material, it conducts heat to the sealant quickly, and when removed the flexibility of the film provides an aggressive pealing angle. As will be seen in the forthcoming description, the film or membrane structure is composed of a printable top layer capable of transmitting heat from the sealing dye without deterioration. A barrier layer engineered to provide the required product protection is included as well as a sealant layer on the underside for bonding to the container rim. This barrier layer may be integral with other layers. Typical barriers include barriers for moisture vapor, light, oxygen, carbon dioxide, and barriers to essential oils.

In the present invention, the membrane must include at least one layer in the structure that provides the necessary tensile strength that is adequate to peel the sealant layer without tearing or elongating. Choices of material for the top layer can include paper, metal and oriented plastic films such as polyester. Additional barrier layers might include vacuum metalized treatments and PVDC coatings. A typical sealant is an EVA copolymer and is available for hot melting. Many similar proprietary formulations exist for this type of material.

The edge or frame of the present invention is usually injection molded from a suitable thermo plastic such as polyethylene or polypropylene and can be bonded to either the underside or topside surface of the membrane structure.

As can be seen in the present invention, the cup rim can be considered to have an outer edge, a top surface and an inner edge. The frame surrounding the membrane film panel snaps over and around the outside perimeter edge of the cup flange such that the membrane film overlaps the top surface of the flange. In this manner, the heat seal bond area can then be positioned inside of the frame of the lid and sealed to the top flange surface which at least a portion in some cases may be tapered in a downward and outward direction. It should be noted that when oriented film is utilized in the present application, and heated during or after the sealing phase, it will remove all slack or excess wrinkles in the membrane. The appearance of the closure after this is that of a rigid top surface. Upon peeling the membrane off and reclosing it the tension is released and the surface becomes flaccid, thus altering its appearance and which may be utilized as evidence of tampering.

Accordingly, from the foregoing it will be obvious that the lidding system of present closure arrangement is less costly as it eliminates the necessity of using a separate expensive aluminum foil layer. It also replaces two pieces with one, reducing in-plant handling and equipment and simplifies customer use, reducing litter, and offering a unique tamper-evident feature.

These and other objects of the invention will be apparent from examination of the following description and drawings.

BRIEF DESCRIPTION OF THE DRAWINGS

A better understanding of the present invention may be had from consideration of the following detailed description taken in conjunction with the following drawings, wherein similar numbers denote similar elements.

DETAILED DESCRIPTION OF THE PREFERRED EMBODIMENTS

Figure 1:
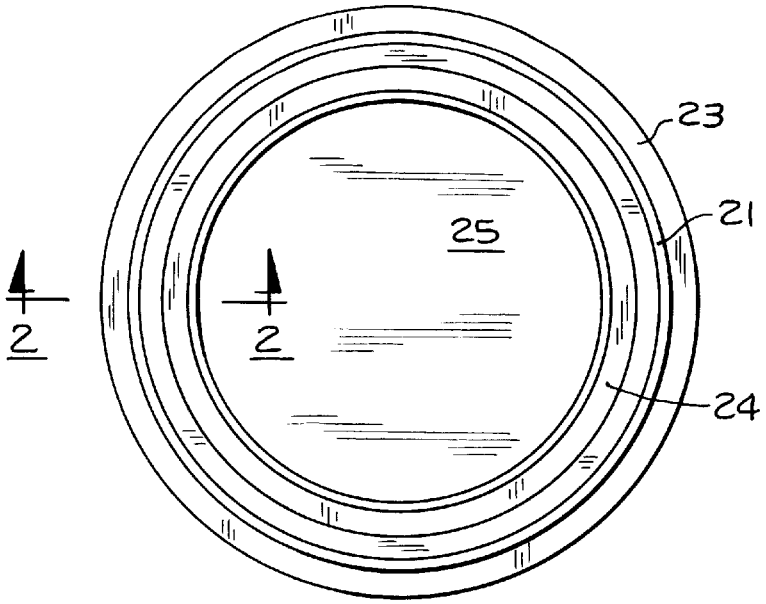
FIG. 1 is a top plan view of a container body and lid having a closure arrangement embodying the features of the present invention.
Figure 2:
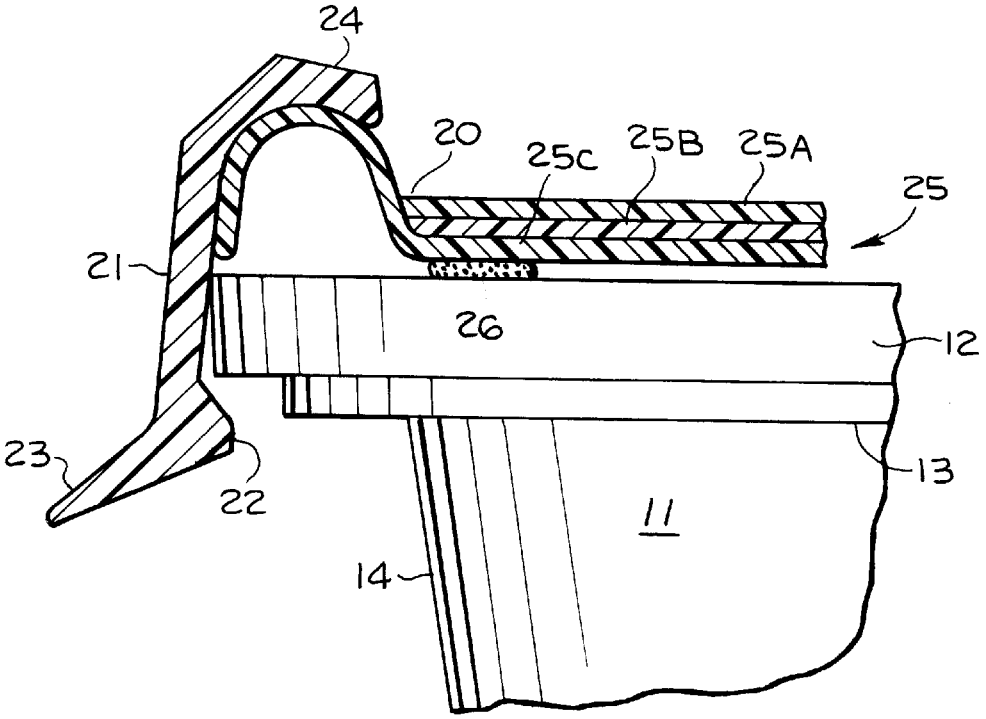
FIG. 2 is a fragmentary vertical section showing the lid portion of the present invention in sectional form taken along lines 2—2 of FIG. 1.
Figure 3:
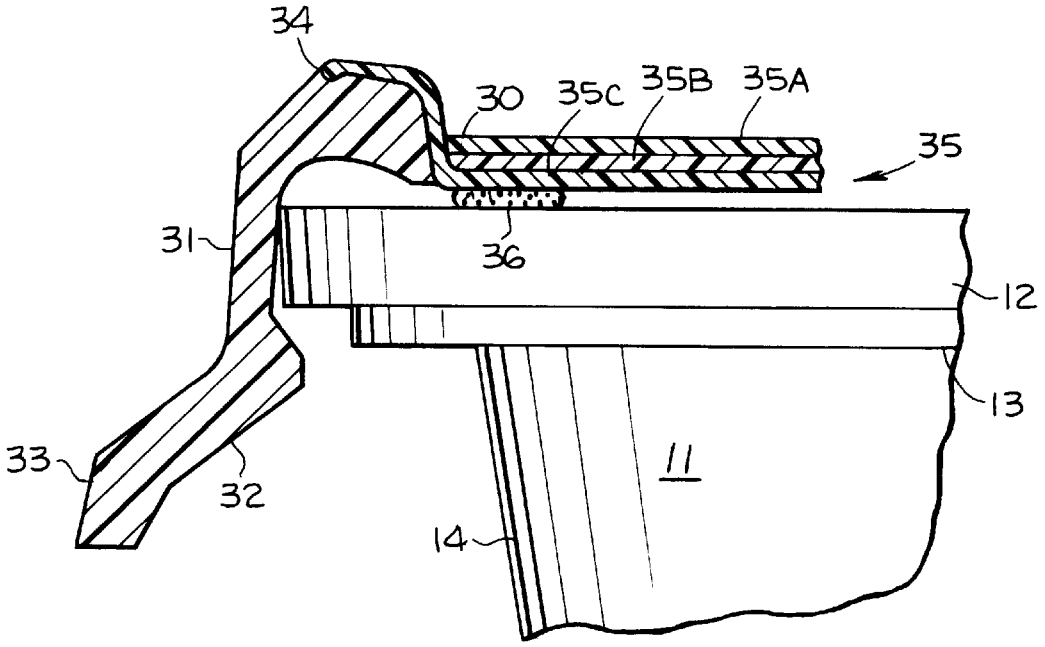
FIG. 3 is a view similar to FIG. 2 but illustrating a modified form of the invention.
Figure 4:
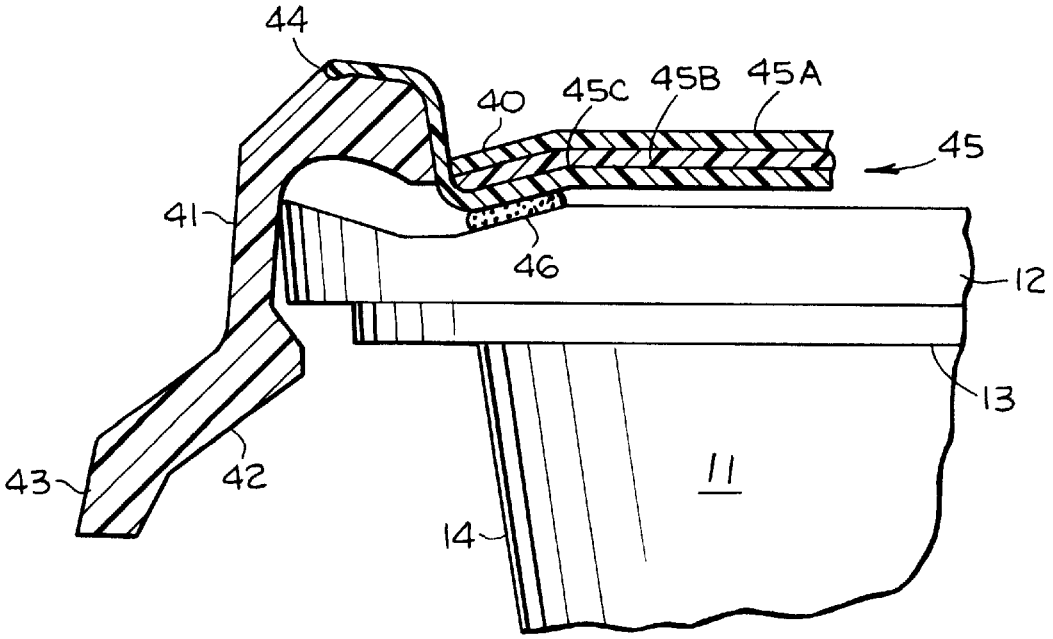
FIG. 4 is a view similar to FIG. 2 but illustrating a modified form of the invention.

Referring now to the drawings for a better understanding of the present invention, it will be seen from the closure arrangement illustrated in FIGS. 2, 3 and 4 that includes a tubular container 11 which is attached to a closure member or lid indicated as 20, 30 or 40 in FIGS. 2, 3 and 4, respectively. In each instance the container 11 as illustrated in the drawings are round in cross-section, the configuration being similar to that shown in FIG. 1. Similar techniques could be applied to containers of oval, hexagonal, rectangular, or other shape without departing from the scope of the present invention.

In the embodiment illustrated in FIGS. 2 and 3, the present container is a one-piece unit formed of molded plastic, metal or paperboard having a tubular body wall 14 which is provided at its upper extremity with a circumferential flange or rim 12 projecting radially outward from the body wall. This rim may slope in a downward and outward direction facilitating heat sealing at location 46 as seen in FIG. 4. Lid 20 has a rim or vertical flange 21, an annular flange 24, and a skirt 23 depending from the outer periphery of the vertical flange 21. Lid 20 also includes a central panel 25 which includes a membrane type material 25A including printing on top and which may be constructed of foil, oriented polyester, a membrane consisting of two layers of oriented polypropylene with printing in between, EVA copolymer film, or a number of similar materials as indicated previously.

The underside 25C of the material of the film must be suitable for heat sealing with the material of the container rim 12. Heat sealing may be applied between the membrane and the top surface of the flange as shown at 26 in FIG. 2. Lid vertical flange 21 includes an upwardly projecting portion 24 to the underside of which is secured membrane 25 by means of heat sealing. Also formed integrally with and projecting radially inward from the lower extremity of vertical flange 21 is an inward annular shoulder lip 22.

After container 11 has been filled and lid 20 has been snapped over the rim 12 of the container, heat is applied to bond the coating on the underside of the lid at point 26. Thus, in this manner, a hermetic seal is formed between the container and its lid.

After the container has been filled and the lid has been snapped over the rim of the container, heat is applied to bond the coating as indicated previously. Should internal pressure be generated within the container and exert pressure on the lid, the sealing surface can be angled (as seen in FIG. 4) downward and outward facilitating heat sealing at location 46 to maintain the sealed surface in shear loading when the membrane is domed (as may occur from internal pressure). In order to intentionally move the lid from the container, one side of the lid can be grasped and pulled upward to peel the lid off of the container rim.

In an alternate but similar embodiment of the present invention, it may be seen in FIG. 3 that a similar container 11 is utilized with a flange 31 having affixed thereto a sealed membrane or film 35. It is noted that this film is applied by heat sealing or similar manner to the upper portion 34 of flange 31. Engagement of the cup edge 12 by lid 30 is accomplished in a manner similar to that previously described.

Likewise, heat sealing by means of the membrane portion of lid 30 to flange 12 cup 11 is accomplished in a similar means by heat sealing in any of several well-known techniques membrane 35 to cup flange 12 at point 36.

During utilization by a customer of a product contained within container 11, the lid is removed as well as the membrane sealed in a single operation. However, by virtue of its construction, the plastic edge of lid 20, 30 or 40 can be utilized to reclose the package because of the rigid rim construction of rims 21, 31 or 41. The cover is replaced by snapping onto the cup flange as an overcap.

The present invention, as indicated, allows the use of flexible films which can be inserted within the rims by a variety of means during assembly, and depending upon their material are heat sealed by conduction heating, by means of a hot dye in connection with the application of plastic-like materials, while if aluminum foil or similar materials are utilized, induction heating may be applied for heat sealing.

In summary, the film structure 25, 35 or 45 may be composed of a printable top layer (25A, 35A or 45A) capable of transmitting heat from the sealing dye without deterioration. A barrier layer (25B, 35B or 45B) is provided beneath that to provide the necessary product protection. A sealant layer (25C, 35C or 45C) on the underside of the film 25, 35, or 45 provides bonding to the container rim. It has been discovered that the top layer (25A, 35A or 45A) material choice for the films sections 25, 35 or 45 might include paper or oriented polyester film while additional barrier layers (25B, 35B or 45B) might include vacuum metalized treatments and PVDC coatings. The sealant layer (25C, 35C or 45C) of films 25, 35 or 45 may be of EVA copolymer and similar materials which can be hot melted. The frames 21, 31 and 41 are injection molded from a suitable plastic, such as polyethylene or polypropylene and can be bonded to the underside of the film structure shown in FIGS. 3 and 4 or the top portion as shown in FIG. 2. As previously noted, the cup rims 12 can be considered having an outer edge, a top surface, and an inner edge. The frame 21, 31 or 41 surrounding the membrane film 25, 35 or 45 overlays the top surface of the flange 12. As previously noted, the heat seal bond area that can be positioned inside of the frame of the lid sealing it to the top flange surface and in some cases the inner flange edge.

During heat sealing, slack or excess wrinkles are removed from membranes 25, 35 or 45 giving the appearance of the closure as a rigid top surface. Upon peeling the membrane lid and reclosing it, the pressure beneath the membrane is released, the tension is released and the surface becomes flaccid, providing, if necessary, an indication of tamper evidence.

While but three similar embodiments of the present invention have been shown, it will be obvious to those skilled in the art that numerous modifications can be made without departing from the spirit of the present invention, which shall be limited only by the scope of the claims appended hereto.

What is claimed is:

1. In combination a container body and a peelable and reclosable lid comprising:

said container body open at one end including a body wall;

a rim surrounding said open and extending radially outward from an inner surface;

said rim including a portion thereof tapered in a downward and outward direction;

said lid adapted for engaging and hermetic sealing said container body;

said lid including a generally flat central panel including a membrane secured to and peelable from said rim;

said membrane including a peeling surface angled downward and outward, heat sealed to said surface of said container body rim tapered in a downward and outward direction;

said membrane including at least one layer of film heat sealed to a surface of said container body rim;

said lid also including a molded plastic edge having a portion secured to a marginal area of said central panel;

a skirt depending from an outer periphery of said edge;

a lip projecting radially inward from a lower extremity of said skirt and defining with portions of said skirt and said central panel, a means for receiving said rim of said container body;

said lid lip having an inner peripheral edge to engage said container rim to maintain said lid and said container body to each other whereby said combination ensures the integrity of said seal.

2. The combination as claimed in claim 1 wherein:

said container body is formed of molded thermoplastic material.

3. The combination as claimed in claim 1 wherein:

said container body is formed of paperboard.

4. The combination as claimed in claim 1 wherein:

said container body includes an outer ply of paperboard and an inner coating of thermoplastic material.

5. The combination as claimed in claim 1 wherein:

said container body is formed of metal.

6. The combination as claimed in claim 1 wherein:

an upper marginal portion of said container body is curved radially outward to form said container body rim.

7. The combination as claimed in claim 1 wherein:

said central membrane panel is secured to an underside of said lid edge.

8. The combination as claimed in claim 1 wherein:

said central membrane panel is secured to a topside of said lid edge.

9. The combination as claimed in claim 1 wherein:

said central membrane panel includes a layer of nylon.

10. The combination as claimed in claim 1 wherein:

said central membrane panel includes a layer of oriented polyester.

11. The combination as claimed in claim 1 wherein:

said central membrane panel includes at least one layer of oriented polypropylene with a printed layer there between.

12. The combination as claimed in claim 1 wherein:

said central membrane panel includes at least one protective layer and at least one metalized layer.

13. The combination as claimed in claim 1 wherein:

said central membrane panel becomes shrunk during heat sealing to eliminate wrinkles contained therein.

14. The combination as claimed in claim 1 wherein:

said central membrane panel of film is exposed to heat after heat sealing of said film to said rim to eliminate wrinkles contained in said film.

15. The combination as claimed in claim 1 wherein:

said central membrane panel includes a single layer of adequate tensile strength to facilitate the peeling of said layer without tearing or elongating.

16. The combination as claimed in claim 1 wherein:

said central membrane panel includes a vacuum metalized layer.

17. The combination as claimed in claim 1 wherein:

said central membrane panel includes an aluminum foil layer.

18. The combination as claimed in claim 1 wherein:

said central membrane panel includes a layer coated by PVDC material.

19. The combination as claimed in claim 1 wherein:

said sealant layer is constructed of EVA copolymer.

20. The combination as claimed in claim 1 wherein:

said central membrane panel includes a barrier layer and a sealant layer.

21. The combination as claimed in claim 20 wherein:

said barrier layer is positioned above said sealant layer to provide contact with any product within said container; and said sealant layer is adapted to be secured to said molded plastic edge.

22. The combination as claimed in claim 20 wherein:

said central membrane panel is sealed conductively to said rim inward of an outer edge.

* * * * *